US005249384A

United States Patent [19]

Dark, Jr.

[11] Patent Number: 5,249,384

[45] Date of Patent: Oct. 5, 1993

[54] APPARATUS AND METHOD FOR DISPLAYING AN ADVERTISEMENT OR MESSAGE INSIDE A GOLF CUP

[75] Inventor: Richard W. Dark, Jr., Bridgeton, Mo.

[73] Assignee: Ad-In-The-Hole International, St. Louis, Mo.

[21] Appl. No.: 861,313

[22] Filed: Mar. 31, 1992

[51] Int. Cl.[5] ..... A63B 57/00; G09F 3/00

[52] U.S. Cl. ..... 40/642; 273/34 R

[58] Field of Search ..... 40/462, 451; 273/34 R, 273/34 A, 34 B

[56] References Cited

U.S. PATENT DOCUMENTS

| | | | |
|---|---|---|---|
| 1,538,822 | 5/1925 | Kennedy | 273/34 A |
| 1,829,283 | 10/1931 | Kip | 273/34 A |
| 4,184,275 | 1/1980 | Thornell | 40/1.5 |

*Primary Examiner*—Kenneth J. Dorner

*Assistant Examiner*—Cassandra Hope Davis

*Attorney, Agent, or Firm*—Rogers, Howell & Haferkamp

[57] ABSTRACT

An apparatus for displaying an advertisement or message inside a golf cup is comprised of a bottom disk releasably securable inside the golf cup, a sheet of material having an advertisement or message marked thereon, and a transparent top disk that is assembled to the bottom disk with the sheet of material enclosed therebetween. The top disk is assembled to the bottom disk by friction, sealing engagement between the two disks. The sealing engagement between the disks protects the sheet of material enclosed between the disks from the outside environment. The transparency of the top disk enables the sheet of material to display an advertisement or message marked on the sheet through the top disk. The message or advertisement displayed is visible from outside the golf cup into which the apparatus of the invention is inserted.

24 Claims, 1 Drawing Sheet

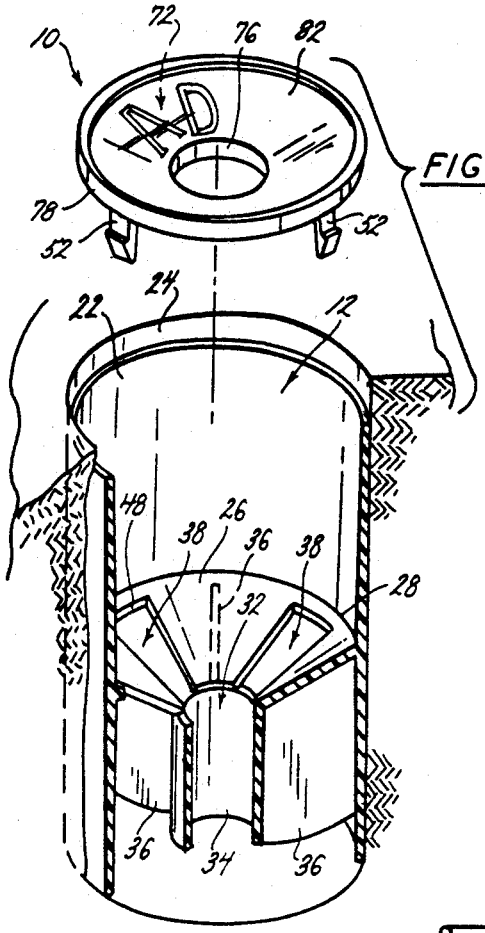
FIG. 1.
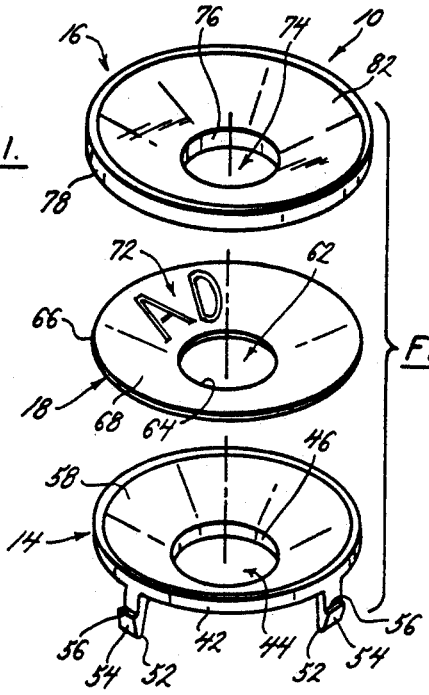
FIG. 3.
FIG. 2.
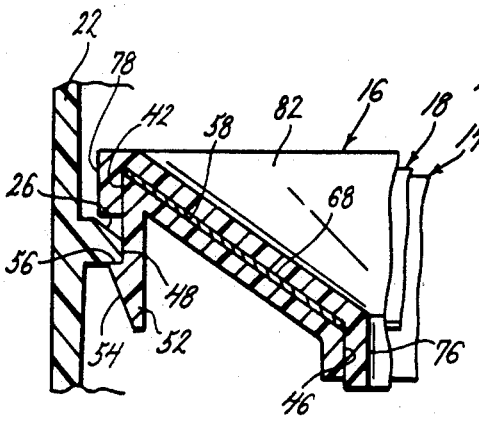
FIG. 4.
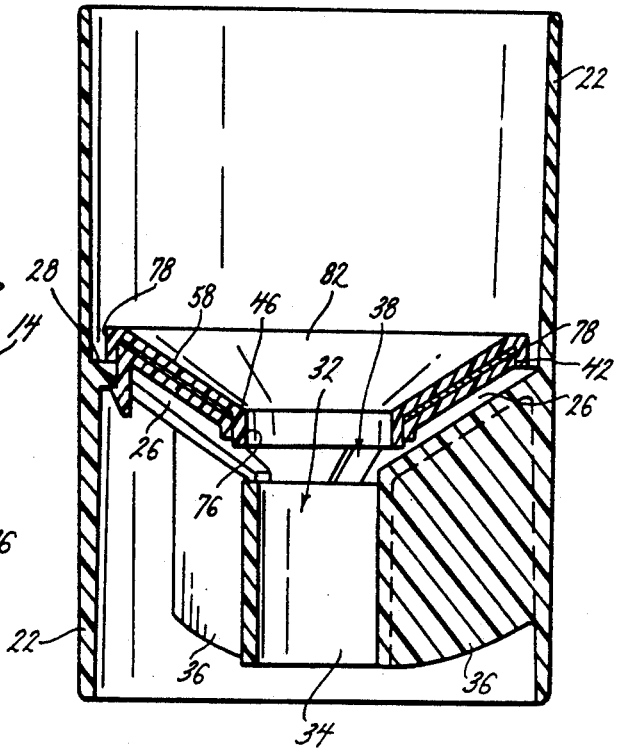

APPARATUS AND METHOD FOR DISPLAYING AN ADVERTISEMENT OR MESSAGE INSIDE A GOLF CUP

BACKGROUND OF THE INVENTION (1) Field of the Invention

The present invention relates to an apparatus and method for displaying an advertisement or message inside a golf cup. In particular, the present invention relates to an apparatus and method for displaying an advertisement or message inside a golf cup where the advertisement or message is replaceable and is contained in a sealed enclosure to protect it from the environment.

(2) Description of the Related Art

Various different devices are known in the prior art for displaying an advertisement at the bottom of a golf cup. Typical devices of this type are disclosed in the U.S. Pat. of Boudreau et al. No. 4,878,665 and Boudreau No. 4,928,417. The devices of the prior art typically comprise a circular disk having an advertisement or message imprinted on the top surface of the disk. The disk is inserted into the golf cup and is secured at the bottom of the golf cup.

Prior art golf cup display devices are disadvantaged in that the advertisements or messages displayed by the devices are imprinted in some manner on the top surface of the disks inserted into the golf cup. The advertisements or messages are exposed to the environment. Over a period of time, the advertisement or message may become faded or completely removed from the surface of the disk by rain, repeated contact with the golf cup flag stick on removal and reinsertion of the stick into the cup, and the repeated contact with golf balls falling into the cup. What is needed to overcome this disadvantage is some type of a protective layer covering over the advertisement or message on the top surface of the circular disk that protects the advertisement or message from rain, contact with the golf hole flag stick, and contact with golf balls hit into the cup.

Prior art golf cup advertisement or message display devices are also disadvantaged in that, should it be desired to replace the advertisement or message with a different advertisement or message, the entire disk must be removed from the cup and replaced with a new disk having the new advertisement or message thereon. If advertisements or messages are changed frequently, the frequent replacement of the disks in each of the golf cup holes of a golf course can amount to a substantial expense. What is needed to overcome this disadvantage of prior art golf cup advertisement and message display devices is a golf cup advertisement or message display device constructed so that the advertisement or message displayed by the device can be easily and inexpensively replaced.

SUMMARY OF THE INVENTION

The present invention overcomes the disadvantages associated with prior art golf cup advertisement and message display devices by providing a golf cup advertisement or message display device that protects the advertisement or message from the surrounding environment and enables the advertisement or message to be quickly and easily changed.

The apparatus of the present invention is comprised of a bottom disk member, a top disk member, and a circular, thin sheet of material that is enclosed between the top and bottom disk members. In the preferred embodiment of the invention, the bottom disk member is constructed entirely of plastic and the top disk member is constructed entirely of a transparent plastic. However, other materials may be employed in constructing the disk members and the top disk member may be constructed so that it is only partially transparent. The sheet of material enclosed between the disk members is preferably a paper product, but may also be other types of thin, flexible materials that are receptive to printing.

The bottom disk member has a circular configuration with a hole at its center. The hole is dimensioned to be larger than the diameter of the typical flag stick of a golf hole. A support surface of the disk member extends from the periphery of the center hole out to the peripheral edge of the disk member. The support surface is tapered and inclines upward slightly as it extends from the center hole out to the peripheral edge of the bottom disk member. Several attachment clips depend downward from the peripheral edge of the disk member. The attachment clips are configured and positioned around the peripheral edge of the bottom disk member to enable the clips to engage inside drainage slots of a conventional golf cup to releasably secure the bottom disk member to the bottom of the golf cup.

The top disk member has a circular configuration that is slightly larger than the circular configuration of the bottom disk member. The top disk member also has a hole at its center having a diameter dimensioned slightly larger than the diameter of a typical flag stick of a golf hole. A center, circular flange surrounds the hole at the center of the top disk member and depends downward from the hole. A cover surface of the top disk member extends radially outward from the center hole to the peripheral edge of the top disk member. The cover surface is tapered and is inclined slightly upward as it extends from the center hole of the top disk to the peripheral edge of the top disk. A circular, peripheral flange surrounds the peripheral edge of the top disk and depends downward from the peripheral edge. The spacing between the center flange of the top disk and the peripheral flange of the top disk is substantially equal to the spacing between the center hole of the bottom disk and the peripheral edge of the bottom disk.

The sheet of material has a circular configuration with a diameter substantially equal to the diameter of the bottom disk support surface. A center hole is provided through the sheet of material. The center hole has a diameter substantially equal to the diameter of the center hole through the bottom disk. The sheet of material is formed in such a way that it has a slight upward taper with the sheet being inclined as it extends outward from the center hole of the sheet to the peripheral edge of the sheet. The top, inclined surface of the sheet is marked with the advertisement or message desired to be displayed inside the golf hole.

The apparatus of the invention is assembled to display an advertisement or message inside a golf hole according to the following method. The sheet of material, with the advertisement or message marked on its top, inclined surface, is positioned on top of the support surface of the bottom disk. The inclination of the sheet of material is predetermined to be substantially equal to the inclination of the support surface of the bottom disk. The sheet of material is centered on the support surface so that the center hole in the sheet is aligned with the center hole of the bottom disk and the peripheral edge of the sheet is aligned with the peripheral edge of the bottom disk.

Next, the top disk is positioned over the sheet and bottom disk and is attached to the bottom disk. The center flange of the top disk is aligned with the center holes of the sheet and bottom disk and the peripheral flange of the top disk is aligned with the peripheral edges of the sheet and bottom disk. The center flange is then inserted through the center hole of the sheet and into the center hole of the bottom disk. Simultaneously, the peripheral flange of the top disk passes over the peripheral edge of the sheet and the peripheral edge of the bottom disk. The top disk is pressed downward onto the bottom disk with the center flange engaging in friction, sealing engagement with the center hole of the bottom disk and the peripheral flange engaging in friction, sealing engagement around the peripheral edge of the bottom disk, thereby sealing the sheet between the top and bottom disks. With the top disk attached to the bottom disk, the advertisement or message marked on the top surface of the sheet is visible through the cover surface of the top disk.

The assembled top disk, sheet and bottom disk are next inserted into the golf cup. The assembled top disk, sheet and bottom disk are pushed downward toward the bottom of the golf cup until the depending clips of the bottom disk engage in the drainage slots of the golf cup, thereby securing the apparatus of the invention to the bottom of the golf cup with the message or advertisement marked on the sheet displayed through the transparent top disk.

BRIEF DESCRIPTION OF THE DRAWINGS

Further objects and features of the present invention are revealed in the following detailed description of the preferred embodiment of the invention and in the drawing figures within:

FIG. 1 is a cutaway perspective view showing the apparatus of the invention being assembled into a conventional golf cup;

FIG. 2 is an elevation view, in section, showing the apparatus of the invention assembled into a conventional golf cup;

FIG. 3 is an exploded perspective view showing the component parts of the apparatus of the invention; and FIG. 4 is a partial elevation view, in section, showing the detail of the connection of the apparatus of the invention to the inside of a conventional golf cup.

DESCRIPTION OF THE PREFERRED EMBODIMENT

The apparatus of the invention 10, for displaying an advertisement or message inside a golf cup, is shown in FIG. 1 in its assembled condition above a conventional golf cup 12 into which it is to be inserted and secured. The component parts of the apparatus of the invention are shown in FIG. 3. The apparatus 10 is basically comprised of a bottom disk 14, a top disk 16, and a circular sheet of material 18 onto which an advertisement or message is marked. The bottom and top disks 14, 16 are preferably constructed of a resilient plastic material and the sheet of material 18 is preferably constructed of paper or paperboard. However, the component parts of the apparatus of the invention 10 may be constructed of other similar types of materials without departing from the intended scope of the invention.

The golf cup 12 shown in the operative environment of the invention is of conventional construction. The particular construction of the golf cup 12 is only one example of possible constructions of conventional golf cups. The apparatus of the invention 10 may be employed with a variety of different golf cup constructions other than that shown with only minor modifications to the apparatus.

As seen in the drawing figures, the golf cup 12 is comprised of a tubular body 22 that is inserted into a hole 24 provided for the cup in a green of a golf course. A tapered bottom surface 26 of the cup is provided toward the bottom of the tubular body 22. The bottom surface 26 has a peripheral edge 28 that is secured to the interior surface of the tubular body 22. The bottom surface 26 tapers downward inside the tubular body 22 toward a center hole 32 in the bottom surface. A cylindrical center sleeve 34 is secured to the underside of the cup bottom surface 26 and depends downward surrounding the center hole 32. The inner diameter of the center sleeve 34 is determined to enable the insertion of a conventional golf flag stick into the sleeve 34. Extending across the underside of the bottom surface 26 and between the sleeve 34 and the inner surface of the tubular body 22 are a plurality of reinforcing webs 36. Spatially arranged between the plurality of webs 36 are drainage slots 38 formed through the bottom surface 26. The slots 38 enable rain water to drain completely through the interior of the golf cup 12.

Each of the component parts of the golf cup 12 may be molded integrally with each other, or may be secured together in any other known method. The construction of the golf cup 12 is conventional and does not form a part of the present invention. Moreover, the described construction of the golf cup 12 is for illustrative purposes and is not intended to be limiting. The apparatus of the invention 10 may be employed with a variety of different types of golf cups with only minor modifications to the apparatus.

As seen in FIG. 3, the bottom disk 14 of the apparatus of the invention has a circular configuration with a peripheral edge 42 and a center hole 44. The center hole 44 is bounded by a circular, center edge 46 of the disk. The diameter of the center edge 46 is slightly larger than the diameter of the golf cup center sleeve 34 as seen in FIG. 2. The peripheral edge 42 of the bottom disk has a diameter slightly smaller than the internal diameter of the golf cup 12. As seen in the drawing figures, the diameter of the peripheral edge 42 of the bottom disk is predetermined to position the bottom disk peripheral edge 42 adjacent to the top edges 48 of each of the drainage slots 38 formed in the golf cup bottom surface 26.

A plurality of engagement tabs 52 are formed integrally with and depend downward from the peripheral edge 42 of the bottom disk. The tabs 52 are spatially arranged around the periphery of the bottom disk in a predetermined arrangement to correspond with the spacing of the drain slots 38 formed in the bottom surface of the golf cup 12. Each of the plurality of tabs 52 is formed with a cam surface 54 on the exterior surface of the tab. The cam surface 54 terminates at a shoulder projection 56 from the exterior surface of each tab. The cam surface 54 and shoulder 56 formed in each tab 52 facilitate the engagement of each tab in a drainage slot 38 of the golf cup as will be explained. Where the apparatus of the invention is employed in golf cups having constructions other than that described above, the tabs may have to be modified or replaced with other structures for securing the bottom disk to the bottom surface of the golf hole.

The bottom disk 14 is provided with a support surface 58 extending from the center edge 46 of the center hole 44 outward to the peripheral edge 42 of the disk. As seen in the drawing figures, the support surface 58 of the bottom disk tapers downwardly from the peripheral edge 42 of the disk toward the center hole 44 of the disk. The inclination of the support surface 58 is predetermined to be equal to or slightly less than the inclination of the golf cup bottom surface 26.

As seen in FIG. 3, the sheet of material 18 has a circular configuration with a center hole 62. The center hole 62 in the sheet of material 18 is bounded by a circular inner edge 64 of the material. The outer circumference of the sheet of material 18 is bounded by a circular peripheral edge 66. A top surface 68 of the sheet of material 18 extends from the center edge 64 of the material out to its peripheral edge 66. The top surface 68 is capable of having an advertisement or message 72 marked thereon in any known method. The sheet of material 18 is preferably paper, facilitating the marking of an advertisement or message 72 on the top surface 68 of the sheet. As seen in the drawing figures, the top surface 68 of the sheet has a tapered inclination that extends downward from the peripheral edge 66 of the sheet to the center edge 64 of the sheet. The inclination of the sheet 18 is predetermined to correspond to the inclination of the top surface 58 of the bottom disk. The diameter of the center hole 62 of the sheet is predetermined to correspond to the diameter of the center hole 44 of the bottom disk, and the diameter of the peripheral edge 66 of the sheet is predetermined to correspond to the diameter of the peripheral edge 42 of the bottom disk. The configuration of the sheet 18 enables it to lay flat on the support surface 58 of the bottom disk 14.

The top disk 16 also has a circular configuration with a hole 74 at its center. The center hole 74 is bounded by a downward depending, circular center flange 76 of the top disk. As shown in the drawing figures, the center flange 76 has an inner diameter slightly larger than the diameter of the golf cup center sleeve 34 to enable insertion and removal of a golf hole flag stick through the center hole 74 of the top disk. The center flange 76 is also provided with an exterior diameter that is substantially equal to the diameter of the bottom disk center edge 46 to enable insertion of the top disk center flange 76 into the center hole 44 of the bottom disk. The diameter dimensions of the top disk center flange 76 and the bottom disk center edge 46 provide a friction, sealing engagement between the exterior of the top disk center flange 76 and the interior of the bottom disk center edge 46.

The top disk 16 is completely bounded by a circular, peripheral flange 78 that depends downward from the peripheral edge of the top disk. As seen in FIGS. 2 and 4, the top disk peripheral edge 74 has an inner surface with a diameter substantially equal to the diameter of the outer surface of the bottom disk peripheral edge 42. This enables the peripheral flange 78 of the top disk to be inserted over and around the peripheral edge 42 of the bottom disk and to engage in a friction, sealing engagement around the peripheral edge 42 of the bottom disk.

The top disk 16 is provided with a cover surface 82 that extends outwardly from the center flange 76 of the disk to the peripheral flange 78 of the disk. The top disk 16 is constructed so that at least the cover surface 82 of the disk is transparent. However, in the preferred embodiment of the invention the entire top disk 16 is molded from a transparent plastic material. As seen in the drawing figures, the top and bottom surfaces of the cover surface 82 of the top disk have an inclination that is substantially equal to the inclination of the top surface 68 of the sheet of material 18 and the support surface 58 of the bottom disk 14. As is best seen in FIGS. 2 and 4, the cover surface 82 of the top disk spaces the center flange 76 from the peripheral flange 78 a predetermined distance that enables the center flange 76 to be inserted inside the center edge 46 of the bottom disk and the peripheral flange 78 to be inserted over and around the peripheral edge 42 of the bottom disk.

In assembling the apparatus of the present invention 10 and inserting and securing the apparatus in the interior of a golf cup 12, the sheet of material 18, with an advertisement or message 72 marked on its top surface 68, is placed with its bottom surface on the support surface 58 of the bottom disk 14. The sheet of material 18 is centered on the support surface 58 so that the circular center edge 64 of the sheet is aligned with the center edge 46 of the bottom disk and the circular peripheral edge 66 of the sheet is aligned with the peripheral edge 42 of the bottom disk.

Next, the top disk 16 is assembled to the sheet 18 and bottom disk 14. The top disk 16 is lowered onto the sheet 18 and bottom disk 14 with the circular center flange 76 aligned with the center holes 62, 44 of the sheet and bottom disk. The circular center flange 76 is inserted through the sheet center hole 62 and into the bottom disk center hole 44 with the exterior surface of the center flange 76 engaging in a friction, sealing engagement with the interior surface of the bottom disk center edge 46. As the top disk 16 is continued to be pressed downward over the sheet 18 and bottom disk 14, the peripheral flange 76 of the top disk passes over the peripheral edge 66 of the sheet and is engaged in a friction, sealing engagement around the exterior of the bottom disk peripheral edge 42. The top disk 16 is continued to be pressed downward over the bottom disk 14 until the sheet of material 18 is pressed tight between the support surface 58 of the bottom disk and the underside of the cover surface 82 of the top disk. The friction sealing engagement between the center flange 76 and the peripheral flange 78 of the top disk and the center edge 46 and the peripheral edge 42 of the bottom disk completely encloses the sheet of material 18 between the two disks. Enclosing the sheet of material in this manner seals the sheet 18 from the outside environment and protects it from the flag stick, golf balls, moisture, dirt and dust. With the cover surface 82 of the top disk 16 being transparent, the advertisement or message 72 marked on the top surface 68 of the sheet of material is visible through the cover surface 82.

FIG. 1 shows the assembled top disk 16, sheet of material 18, and bottom disk 14 of the apparatus 10 ready for insertion into the interior of the golf cup 12. The assembled apparatus 10 is inserted into the interior of the golf cup 12 with each tab 52 of the apparatus aligned with one of the drain slots 38 of the golf cup. As the apparatus is inserted downward into the golf cup, the cam surfaces 54 of each tab 52 engage in sliding engagement over the top edge 48 of each drain slot 38. As the assembly is continued to be pressed downward into the golf cup, the cam surfaces 54 slide over the top edges 48 of the slots until they completely pass the slots, and the shoulder surfaces 56 of each tab engage beneath the top edges 48 of the slots. By constructing the component parts of the apparatus from a resilient plastic material, each of the tabs 54 resiliently flexes inward as the tabs are passed by the top edges 48 of the slots. With the shoulders 56 of each tab engaged under the undersides of the top edges 48 of the slots, the apparatus of the invention is securely held in its operative position against the bottom surface 26 of the golf cup 12. In this position of the apparatus, a golfer looking into the interior of the golf cup 12 can easily see the advertisement or message 72 marked on the sheet of material 18 and displayed through the transparent cover surface 82 of the top disk 16.

Should it be desired to replace the advertisement or message in the apparatus, the apparatus is removed from the interior of the golf cup 12 and disassembled to remove the old sheet from between the top and bottom disks. The top and bottom disks are then reassembled with a new sheet of material 18 displaying a new advertisement or message between the top and bottom disks 14, 16 of the apparatus. The transparent top disk 16 protects the new advertisement or message 17 marked on the sheet of material 18 from its surrounding environment, and protects the advertisement or message from being marred or obscured from repeated insertions of a golf flag stick into the golf cup or from repeated contact with a golf ball falling into the cup.

While the present invention has been described by reference to a specific embodiment, it should be understood that modifications and variations of the invention may be constructed without departing from the scope of the invention defined in the following claims.

What is claimed is:

1. An apparatus for displaying an advertisement or message inside a golf cup, the apparats comprising:

means for displaying a marking for an advertisement or message;

means for supporting the displaying means, the supporting means being adapted to be selectively inserted and removed from a golf cup interior;

means for covering the displaying means supported on the supporting means, the covering means being attached to the supporting means;

the supporting means is a circular bottom disk insertable into and removable from a golf cup interior;

the covering means is a circular top disk releasably attachable to the bottom disk with the displaying means therebetween;

the bottom disk has a peripheral edge and a center hole and a support surface extending therebetween, the support surface supporting the displaying means on top of the support surface; and the top disk has a peripheral edge with a peripheral flange surrounding the edge, and a center hole with a center flange surrounding the center hole, the peripheral flange is engagable around the peripheral edge of the bottom disk and the center flange is engagable inside the center hole of the bottom disk to releasably attach the top disk to the bottom disk.

2. The apparatus of claim 1, wherein:

the top disk has a cover surface extending between the peripheral flange and the center flange, the cover surface is transparent and covers over the displaying means supported by the bottom disk with the top disk attached to the bottom disk.

3. The apparatus of claim 1, wherein:

the peripheral flange engages in a friction, sealing engagement around the peripheral edge of the bottom disk and the center flange engages in a friction, sealing engagement inside the center hole of the bottom disk.

4. The apparatus of claim 1, wherein:

the displaying means is a thin, circular sheet of material having a message marked thereon.

5. An apparatus for displaying an advertisement or message inside a golf cup, the apparatus comprising:

means for displaying an advertisement or message, the displaying means having a top surface and a bottom surface with the top surface receiving markings for an advertisement message;

means for supporting the displaying means, the supporting means being selectively insertable into and removable from a golf cup interior, and the supporting means having a support surface for supporting the displaying means thereon;

means for covering over the displaying means and the supporting means, the covering means being releasably attachable to the supporting means in a position relative to the supporting means where the displaying means supported by the supporting means is entirely covered over by the covering means;

the displaying means is a thin sheet of material having an advertisement or message marked thereon;

the supporting means is a circular bottom disk;

the covering means is a circular top disk releasably attachable to the bottom disk with the sheet of material supported thereon, thereby enclosing the sheet of material between the bottom disk and top disk;

the bottom disk has a peripheral edge and a center hole with the support surface of the bottom disk extending therebetween, the support surface supports the sheet of material thereon; and, the top disk has a peripheral edge with a peripheral flange depending therefrom, and a center hole with a center flange depending therefrom, the peripheral flange is engagable around the peripheral edge of the bottom disk and the center flange is engagable inside the center hole of the bottom disk to releasably attach the top disk to the bottom disk with the sheet of material enclosed therebetween.

6. The apparatus of claim 5, wherein:

the sheet of material is replaceable, and the releasable attachment of the top disk to the bottom disk enables the top disk to be separated from the bottom disk to replace the sheet of material enclosed therebetween.

7. The apparatus of claim 5, wherein:

the top disk has a cover surface extending between the peripheral flange and the center flange, the cover surface is transparent and covers over the sheet of material supported on the support surface of the bottom disk with the top disk attached to the bottom disk.

8. The apparatus of claim 5, wherein the peripheral flange engages in a sealing engagement around the peripheral edge of the bottom disk and the center flange engages in a sealing engagement inside the center hole of the bottom disk to seal the sheet of material between the top disk and bottom disk.

9. An apparatus for displaying an advertisement or message inside a golf cup, the apparatus comprising:

a display member for displaying a marking for an advertisement or message;

a support member for receiving and supporting the display member thereon, the support member being configured to be insertable into and removable from a golf cup interior;

a cover member configured to be attached to the support member with the cover member covering the display member supported on the support member;

the support member is a circular bottom disk having means for releasably attaching the disk to a golf cup interior; and the cover member is a circular top disk having means for releasably attaching the to disk to the bottom disk with the display member therebetween.

10. The apparatus of claim 9, wherein:

the cover member is configured to be attached to the support member and seal the display member supported on the support member between the cover member and support member.

11. The apparatus of claim 9, wherein:

the cover member is releasably attachable to the support member over the display member supported on the support member, and the cover member is at least partially transparent enabling the display member on the support member to be viewed through the cover member.

12. The apparatus of claim 9, wherein:

the bottom disk has a peripheral edge and a center hole and a support surface extending therebetween, the support surface supporting the display member on top of the support surface; and, the top disk has a peripheral edge with a peripheral flange surrounding the edge, and a center hole with a center flange surrounding the center hole, the peripheral flange is engagable around the peripheral edge of the bottom disk and the center flange is engagable inside the center hole of the bottom disk to releasably attach the top disk to the bottom disk.

13. The apparats of claim 12, wherein:

the top disk has a cover surface extending between the peripheral flange and the center flange, the cover surface is transparent and covers over the display member supported on the bottom disk with the top disk attached to the bottom disk.

14. The apparatus of claim 12, wherein:

the peripheral flange engages in a friction, sealing engagement around the peripheral edge of the bottom disk and the center flange engages in a friction, sealing engagement inside the center hole of the bottom disk.

15. The apparatus of claim 9, wherein:

the display member is a thin, circular sheet of material having a message marked thereon.

16. The apparatus of claim 9, wherein:

the top disk is transparent, enabling the display member supported on the bottom disk to be seen through the top disk.

17. An apparatus for displaying an advertisement or message inside a golf cup, the apparatus comprising:

a display member for displaying an advertisement or message, the display member having a top surface and a bottom surface with the top surface receiving markings for an advertisement or message;

a support member for supporting the display member inside a golf cup, the support member having means for mounting the support member inside a golf cup interior, and the support member having a support surface for supporting the display member thereon; and, a cover member for covering over the display member and the support member, the cover member being releasably attachable to the support member in a position relative to the support member where the display member supported on the support member is entirely covered over by the cover member.

18. The apparatus of claim 17, wherein:

the cover member is at least partially transparent, enabling the display member to be seen with the cover member covering over the display member.

19. The apparatus of claim 17, wherein:

the cover member is attachable to the support member by sealing engagement between the cover member and the support member, the sealing engagement sealing the display member between the cover member and the support member.

20. The apparatus of claim 17, wherein:

the display member is a thin sheet of material having an advertisement or message marked thereon;

the support member is a circular bottom disk having means for releasably attaching the bottom disk to an interior of a golf cup; and, the cover member is a circular top disk releasably attachable tot he bottom disk with the sheet of material supported thereon, thereby enclosing the sheet of material between the bottom disk and the to disk.

21. The apparatus of claim 20, wherein:

the bottom disk has a peripheral edge and a center hole with the support surface of the bottom disk extending therebetween, the support surface supports the sheet of material thereon; and, the top disk has a peripheral edge with a peripheral flange depending therefrom, and a center hole with a center flange depending therefrom, the peripheral flange is engagable around the peripheral edge of the bottom disk and the center flange is engagable inside the center hole of the bottom disk to releasably attach the top disk to the bottom disk with the sheet of material enclosed therebetween.

22. The apparatus of claim 21, wherein:

the sheet of material is replaceable, and the releasable attachment of the top disk to the bottom disk enables the top disk to be separated from the bottom disk to replace the sheet of material enclosed therebetween.

23. The apparatus of claim 21, wherein:

the top disk has a cover surface extending between the peripheral flange and the center flange, the cover surface is transparent and covers over the sheet of material supported on the support surface of the bottom disk with the top disk attached to the bottom disk.

24. The apparatus of claim 21, wherein:

the peripheral flange extends in a sealing engagement around the peripheral edge of the bottom disk and the center flange engages in a sealing engagement inside the center hole of the bottom disk to seal the sheet of material between the top disk and bottom disk.

* * * * *